US009387983B2

(12) United States Patent
Happy et al.

(10) Patent No.: US 9,387,983 B2
(45) Date of Patent: Jul. 12, 2016

(54) FLEXIBLE MODULAR LIQUID DAM

(71) Applicants: Michael M. Happy, Jacksonville, FL (US); Mark D. Shaw, Jacksonville, FL (US)

(72) Inventors: Michael M. Happy, Jacksonville, FL (US); Mark D. Shaw, Jacksonville, FL (US)

( * ) Notice: Subject to any disclaimer, the term of this patent is extended or adjusted under 35 U.S.C. 154(b) by 0 days.

(21) Appl. No.: 14/472,601

(22) Filed: Aug. 29, 2014

(65) Prior Publication Data

US 2015/0063912 A1 Mar. 5, 2015

Related U.S. Application Data

(60) Provisional application No. 61/872,191, filed on Aug. 30, 2013.

(51) Int. Cl.
*E02B 7/02* (2006.01)
*B65D 90/24* (2006.01)

(52) U.S. Cl.
CPC ..... *B65D 90/24* (2013.01)

(58) Field of Classification Search
CPC ..... E02B 3/106
USPC ..... 405/107, 111, 114–116
See application file for complete search history.

(56) References Cited

U.S. PATENT DOCUMENTS

| | | | | | |
|---|---|---|---|---|---|
| 803,380 | A | * | 10/1905 | Wickre | 52/605 |
| 919,788 | A | * | 4/1909 | Smith | 405/31 |
| 4,031,676 | A | | 6/1977 | Dally | |
| 4,265,062 | A | | 5/1981 | Klibofske | |
| 4,319,440 | A | * | 3/1982 | Rassias et al. | 52/438 |
| 4,813,811 | A | * | 3/1989 | Adams | 404/15 |
| 5,120,156 | A | | 6/1992 | Rauch | |
| 5,236,281 | A | | 8/1993 | Middleton | |
| 5,452,541 | A | * | 9/1995 | DeMaio | 47/33 |
| 5,454,195 | A | | 10/1995 | Hallsten | |
| 5,921,709 | A | * | 7/1999 | Baum et al. | 405/16 |
| 6,022,172 | A | * | 2/2000 | Siyaj | 405/110 |
| 6,231,272 | B1 | * | 5/2001 | Bishop | 405/286 |
| 6,588,979 | B1 | * | 7/2003 | Pasij | 405/114 |
| 8,454,269 | B2 | | 6/2013 | Johnson et al. | |

* cited by examiner

*Primary Examiner* — Tara M. Pinnock
(74) *Attorney, Agent, or Firm* — Thomas C. Saitta

(57) ABSTRACT

A modular liquid dam having a plurality of individual elongated members that can be assembled in an end-to-end relationship to form a temporary liquid retainer or diverter on a substrate surface. The dam members are provided with one or more longitudinal bores or passages that reduce the amount of material in each member. The bores may extend completely through the dam member, may be internal bores closed off at each end, or may be bore segments intermittently spaced within the dam member. Preferably the bore members are open on at least one end of the dam member such that a stiffener rod or rods of varying rigidity may be inserted to increase and vary the rigidity of the dam member.

13 Claims, 1 Drawing Sheet

FLEXIBLE MODULAR LIQUID DAM

This application claims the benefit of U.S. Provisional Patent Application No. 61/872,191, filed Aug. 30, 2013.

BACKGROUND OF THE INVENTION

This invention relates generally to temporary liquid dams, dikes or barriers to retain or divert liquids on a surface, and more particularly to liquid dam assemblies of modular flexible components.

It is often desirable to retain or divert liquid flows of relatively small depth, such as a few inches, with liquid dams that can be quickly and easily installed as needed, such as for example when pipes burst, liquid containers leak or spills occur, especially indoors. It is well known to provide modular liquid dams that can be assembled as needed, the dams comprising elongated members formed of a generally soft or tacky polymeric elastomer material (e.g., polyurethane or polyvinylchloride) such that the bottom of the dam members provide sufficient contact with the substrate surface to prevent passage of the liquid under the dam. It is preferred that the dam comprise a number of portable segments or members assembled end-to-end, as the modular nature of the dam allows for formation of many different configurations as required. The members are abutted to form an elongated barrier, and the members may be provided with joining mechanisms. Examples of such devices are shown in U.S. Pat. No. 4,031,676, U.S. Pat. No. 5,236,281, U.S. Pat. No. 5,454,195, U.S. Pat. No. 6,022,172, U.S. Pat. No. 6,588,979, and U.S. Pat. No. 8,454,269.

A significant problem with the known modular dams is the cost of materials. Another significant problem is that the flexibility of the dams are determined by the choice of material and its density, such that some dam assemblies may be relatively rigid while others may be relatively flexible. It is an object of this invention to address both of these problems by providing a modular liquid dam having reduced material costs and adjustable flexibility.

SUMMARY

In general the invention is a modular liquid dam comprising a plurality of individual, liquid impermeable, elongated members or segments that can be assembled in an end-to-end relationship to form a temporary retainer or diverter on a substrate surface. The members are of sufficient weight and have a base or bottom surface, preferably substantially flat or planar, of sufficient width to preclude passage of liquid beneath the member when placed onto the substrate. The members are composed of a soft, compressible, flexible, resilient non-rigid polymeric elastomer material, such as e.g., polyurethane, polyethylene or polyvinylchloride, having a density that allows the bottom surface to weep or sag to conform to some degree with imperfections in the substrate in order to provide a better seal.

The dam members are provided with one or more longitudinal bores or passages that reduce the amount of material required to make each member, thereby reducing manufacturing costs. The bores may extend completely through the dam member, may be internal bores closed off at each end, or may be intermittently spaced within the dam member. Intermittent bore members result in bridging structures of solid material to increase the structural integrity of the dam member. Preferably the bore members are open on at least one end of the dam member such that a stiffener rod or rods of varying rigidity may be inserted into the dam members to increase and vary the rigidity of the dam member as desired. Additionally, connection members may be inserted in the open ends of the bores to provide a mechanical or friction fit between adjoining dam members.

DETAILED DESCRIPTION

Figure 1:
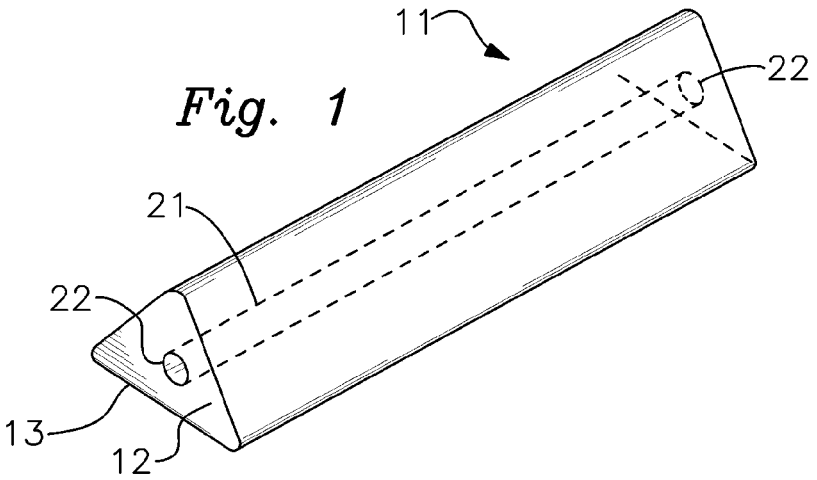
FIG. 1 is a perspective view of an embodiment of the invention showing a single longitudinal bore extending completely through a dam member, no stiffener rod being present.

The invention in its various embodiments will now be described with reference to the drawings. In general the invention is a modular liquid dam, dike or barrier assembly comprising a plurality of individual elongated dam members or segments 11 having ends 12 such that the dam members 11 can be assembled or abutted in an end-to-end relationship to form a temporary retainer or diverter to control liquid on a substrate surface. The configuration of the ends 12 may be generally flat and perpendicular to the longitudinal axis as shown FIGS. 1-3, or they may be angled, or they may be formed with mating three-dimensional configurations as shown for example in FIG. 4 such that the ends 12 of adjoining dam members 11 interlock mechanically or by friction-fit.

The dam members 11 are of sufficient weight and have a base or bottom surface 13, preferably planar, of sufficient width to preclude passage of liquid beneath the dam member 11 when placed onto the substrate. The dam members 11 are composed of a soft, compressible, flexible, non-rigid polymeric elastomer material, such as e.g., polyurethane, polyethylene or polyvinylchloride, having a density that allows the bottom surface 13 to conform to some degree with imperfections in the substrate in order to provide a better seal. The configuration of the dam member 11 may vary, and may for example be triangular (as shown), rectangular, rounded, etc., in cross-section.

Figure 2:
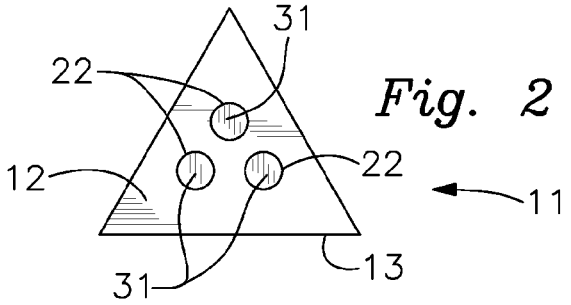
FIG. 2 is an end view of an alternative embodiment or a dam member showing the presence of three longitudinal bores receiving stiffener rods.
Figure 3:
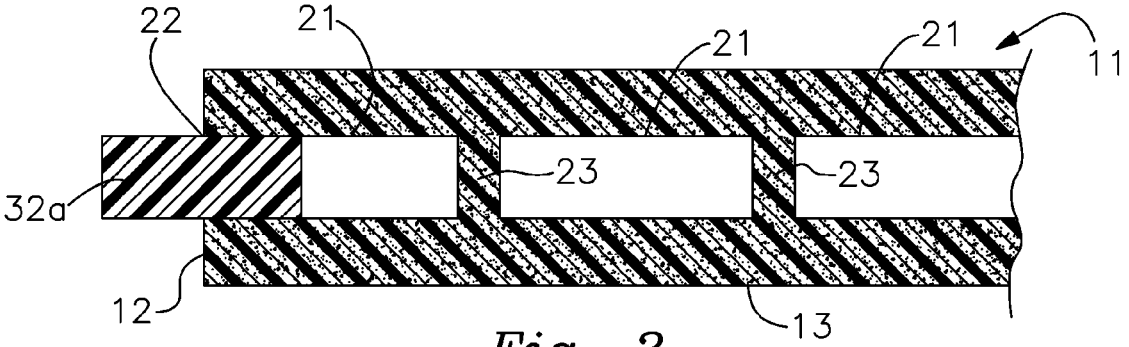
FIG. 3 is a partial cross-sectional view of another embodiment showing intermittent bores within a dam member and showing a connection member inserted into the open end of one bore.
Figure 4:
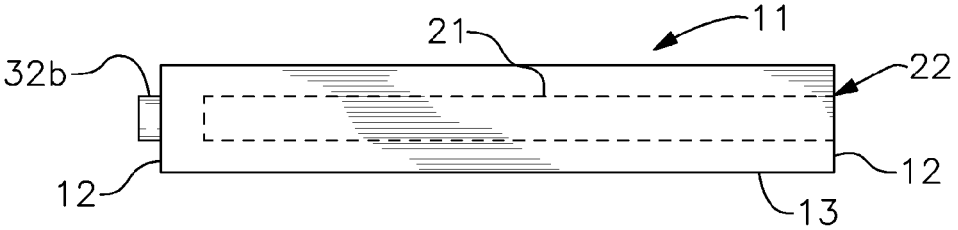
FIG. 4 is a view of another embodiment showing a preformed connection member on one end of the dam member and an elongated bore extending through the other end, such that the connection member of one dam member may be received within the open bore of another dam member when assembled end-to-end.

The dam members 11 are provided with one or more longitudinal bores or passages 21 that reduce the amount of material present in each dam member 11, thereby reducing manufacturing costs. The bores 21 may extend completely through the dam member 11 such that open bore ends 22 are defined, as shown in FIG. 1, or may be internal bores 21 closed off at one end, as shown in FIG. 4, or closed off at each end, or may be bores 21 intermittently spaced within the dam member 11, as shown in FIG. 3. The use of intermittent bore members 21 results in solid material internal bridging structures 23 which increase the structural integrity and reduce the flexibility of the dam member 11 to preclude or minimize tearing or collapsing.

Preferably the bore members 21 are open on at least one end 12 of the dam member 11 such that stiffener members 31, such as tubes or rods, of varying rigidity may be inserted into the open bore ends 22 of the dam members 11 to increase and vary the rigidity of the dam members 11 as desired, the stiffener members 31 being of greater rigidity than said dam members 11. The stiffener members 31 may be composed of various polymers having differing rigidity characteristics, but may also be composed of other materials, including materials that are very rigid, such as for example metal rods, metal tubes or wooden dowels. Preferably the stiffener members 31 are removable and interchangeable.

Physical connection members 32 may be provided such that a mechanical or friction fit is achieved between adjoining dam members 11 when assembled. For example, connection members 32 may be a rigid or non-rigid metal or plastic rod member 32*a* inserted in the open end 22 of the bore 21, as shown in FIG. 3, the connection member 32 being received by a corresponding bore socket or open end 22 formed in the end of another dam member 11. Alternatively, the connection members 32 may be a combination of integral physical features formed when the dam member 11 is molded, the physical features being a male member extending from the dam member end 12, as shown by the post 32*b* in FIG. 4, which is receivable by a corresponding bore open end 22 or socket formed in the end of another dam member 11.

Manufacture of the dam members 21 may be accomplished by a pouring uncured polymer to partially fill an open-topped mold, then inserting a sacrificial cylindrical member that may be removed after curing, such as for example a foam rod or a tubular member, or a permanent member designed to be left within the dam member 11, such as for example a thin-walled, tubular bladder member filled with gas. After placement of the bore-defining member in the uncured polymer within the mold, the remainder of the mold is filled. Upon curing, removable bore-defining members are extracted from the bores 21.

In this manner a plurality of dam members 11 may be formed and stored until needed to retain or direct a liquid. When required, the dam members 11 are assembled end-to-end to define the elongated barrier. If the circumstances require either a stiffer or more flexible barrier, stiffener rods 31 may be added, exchanged or removed as desired.

It is understood that equivalents and substitutions for elements and structures described above may be obvious to those of skill in the art. The described embodiments and figures are meant to be illustrative and not limiting. The true scope and definition of the invention therefore is to be as set forth in the following claims.

We claim:

1. A liquid impermeable modular dam comprised of a plurality of dam members positioned in an end-to-end manner, said dam members formed of a compressible, resilient, non-rigid, polymeric elastomer material, each said dam member comprising at least one longitudinal bore and one or more stiffener members removably disposed in said at least one longitudinal bore, said stiffener members being of greater rigidity than each said dam member, such that the rigidity of said dam members is increased when said stiffener members are disposed therein, wherein said at least one longitudinal bore is a segmented bore whereby said dam member comprises internal bridging members.

2. The modular dam of claim 1, wherein said at least one longitudinal bore is open on both ends.

3. The modular dam of claim 1, wherein each said dam member comprises ends and said at least one longitudinal bore is open on at least one of said ends.

4. The modular dam of claim 1, wherein said at least one longitudinal bore is closed on both ends.

5. The modular dam of claim 1, wherein said stiffener members have varying rigidity.

6. The modular dam of claim 1, further comprising physical connection members adapted to connect said dam members to each other.

7. The modular dam of claim 1, wherein said dam members are triangular in cross-section.

8. The modular dam of claim 1, wherein said dam members are formed of an elastomer material chosen from the group of elastomer materials consisting of polyurethane, polyethylene and polyvinylchloride.

9. The modular dam of claim 1, wherein each said dam member comprises ends wherein said ends of adjoining dam members are configured to mechanically interlock with each other.

10. The modular dam of claim 1, wherein each said dam member comprises ends wherein said ends of adjoining dam members are configured to friction-fit with each other.

11. A liquid impermeable modular dam comprised of a plurality of dam members positioned in an end-to-end manner, said dam members formed of a compressible, resilient, non-rigid, polymeric elastomer material, each said dam member comprising at least one longitudinal bore extending over the majority of the longitudinal length of each said dam member; wherein said at least one longitudinal bore is a segmented bore such that said dam member comprises internal bridging members.

12. The modular dam of claim 11, wherein each said dam member comprises ends and said at least one longitudinal bore is open on at least one of said ends.

13. The modular dam of claim 12, wherein said at least one longitudinal bore is open on both ends.

* * * * *